US010249272B2

(12) United States Patent
Sikra

(10) Patent No.: US 10,249,272 B2
(45) Date of Patent: Apr. 2, 2019

(54) PERCUSSION INSTRUMENT WITH ADJUSTABLE AUXILIARY DEVICE

(71) Applicant: DRUM WORKSHOP, INC., Oxnard, CA (US)

(72) Inventor: Richard A. Sikra, Thousand Oaks, CA (US)

(73) Assignee: Drum Workshop, Inc., Oxnard, CA (US)

( * ) Notice: Subject to any disclaimer, the term of this patent is extended or adjusted under 35 U.S.C. 154(b) by 0 days.

(21) Appl. No.: 15/872,914

(22) Filed: Jan. 16, 2018

(65) Prior Publication Data

US 2018/0211640 A1 Jul. 26, 2018

Related U.S. Application Data

(60) Provisional application No. 62/447,399, filed on Jan. 17, 2017.

(51) Int. Cl.
*G10D 13/02* (2006.01)

(52) U.S. Cl.
CPC ..... *G10D 13/021* (2013.01); *G10D 13/025* (2013.01)

(58) Field of Classification Search
CPC ..... G10D 13/021; G10D 13/025
See application file for complete search history.

(56) References Cited

U.S. PATENT DOCUMENTS

| | | | |
|---|---|---|---|
| 478,611 | A | 7/1892 | Knittel |
| 4,026,185 | A | 5/1977 | Migirian |
| 4,168,064 | A | 9/1979 | Petrovic |
| D288,696 | S | 3/1987 | Hoshino |
| 5,385,075 | A | 1/1995 | Carnes |
| D571,851 | S | 6/2008 | Myers |

(Continued)

FOREIGN PATENT DOCUMENTS

| | | |
|---|---|---|
| CA | 2681889 | 4/2011 |
| DE | 202005020022 U1 | 2/2006 |

(Continued)

OTHER PUBLICATIONS

Alex Slifer, Building a Cajon: A First Foray ino Acoustic Instrument Building, Physics 401, Spring 2012, http://courses.physics.illinois.edu/phys406/Student_Projects.

(Continued)

*Primary Examiner* — Kimberly Lockett
(74) *Attorney, Agent, or Firm* — Ferguson Case Orr Paterson LLP

(57) ABSTRACT

Percussion instruments such as cajóns including auxiliary devices such as snares are disclosed. The positioning of the auxiliary device or devices with respect to the main body of the percussion instrument can be adjustable so as to produce different sounds depending upon the auxiliary device position. In one embodiment, a lever device on the back of a cajón is used. The lever device is linked to one or more snares by an adjustment rod and/or an auxiliary bar. As the lever device is adjusted, the positioning of the one or more snares and the amount of the snare wires that is in contact with the back of the tapa is adjusted, resulting in different sounds when the cajón is played.

22 Claims, 6 Drawing Sheets

(56) References Cited

U.S. PATENT DOCUMENTS

| | | | | |
|---|---|---|---|---|
| 7,482,522 | B2 | 1/2009 | Wening | |
| 7,601,901 | B2 | 10/2009 | Payerl | |
| 8,008,560 | B2 | 8/2011 | Wiese | |
| D650,832 | S | 12/2011 | Wiese | |
| 8,115,088 | B2 | 2/2012 | Herrara | |
| 8,263,848 | B2 | 9/2012 | Aspland | |
| 8,481,834 | B2 | 7/2013 | Eduardo | |
| 8,487,170 | B2 | 7/2013 | Klein | |
| 8,735,703 | B2 | 5/2014 | Dublin | |
| 8,735,704 | B2 | 5/2014 | Buchner | |
| 8,829,321 | B2 | 9/2014 | Klein | |
| 8,835,733 | B2 | 9/2014 | Boulet et al. | |
| 9,087,497 | B1 | 6/2015 | Krol et al. | |
| D735,265 | S | 7/2015 | Pires | |
| 9,263,010 | B2 | 2/2016 | Trask | |
| 9,406,286 | B1 * | 8/2016 | Simonek ..... | G10D 13/025 |
| 9,466,273 | B2 | 9/2016 | Krol et al. | |
| D786,337 | S | 4/2017 | Chandontrikit | |
| 2008/0034944 | A1 | 2/2008 | Aspland | |
| 2014/0000436 | A1 | 1/2014 | Krol et al. | |
| 2014/0041508 | A1 | 2/2014 | Trask | |
| 2014/0373699 | A1 | 12/2014 | Drushal et al. | |
| 2015/0114206 | A1 | 4/2015 | Krol et al. | |

FOREIGN PATENT DOCUMENTS

| | | | |
|---|---|---|---|
| DE | 202007000686 | U1 | 5/2007 |
| DE | 202015001744 | U1 | 4/2015 |
| ES | 1073064 | | 1/2011 |
| JP | 2011-008040 | | 1/2011 |
| JP | 2012-022103 | | 2/2012 |
| JP | 3184744 | | 7/2013 |
| KR | 100828662 | | 5/2008 |
| TW | 491238 | | 12/2014 |

OTHER PUBLICATIONS http://www.cajondg.com/en/products/tecspec.html.
How to adjust the Top Corners of a Cajon for Slap/Crackle Effect, http://blog.x8drums.com/2009/07.

* cited by examiner

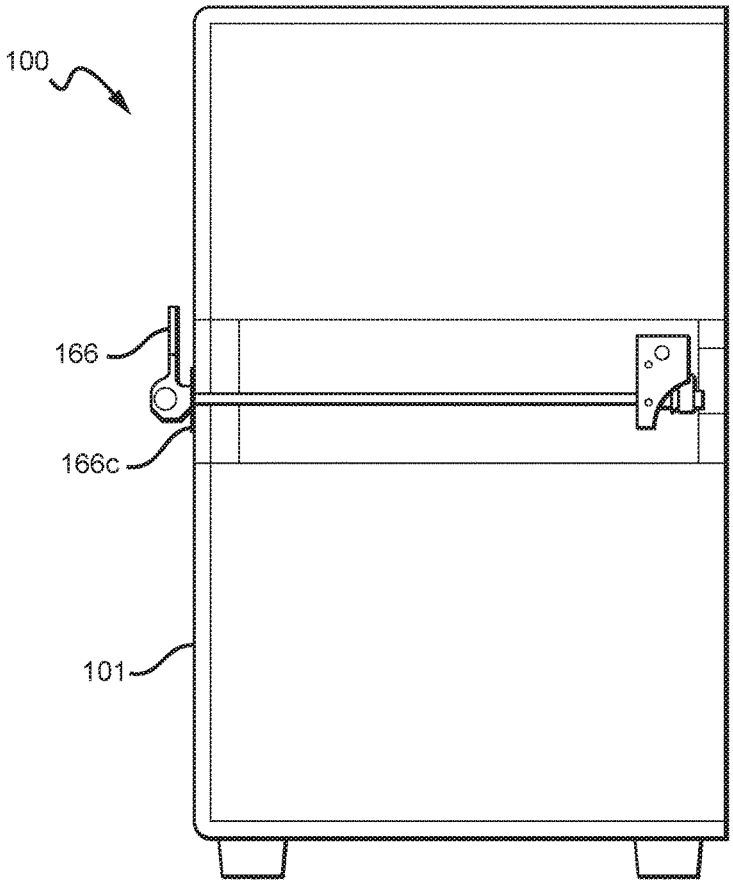
FIG. 1C
FIG. 2
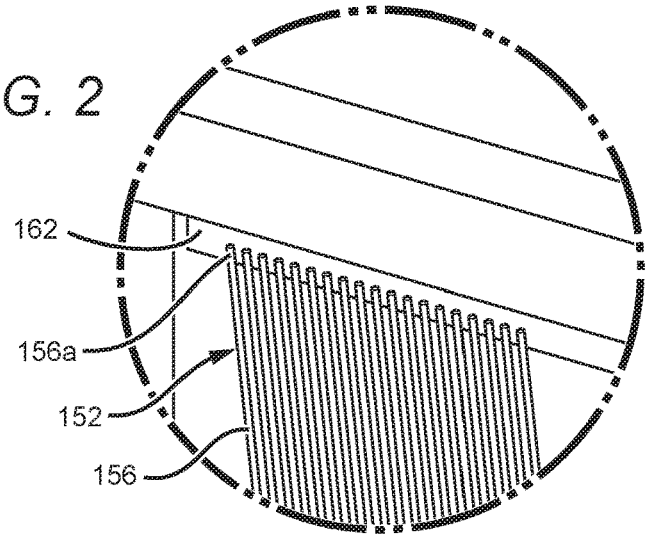

FIG. 8
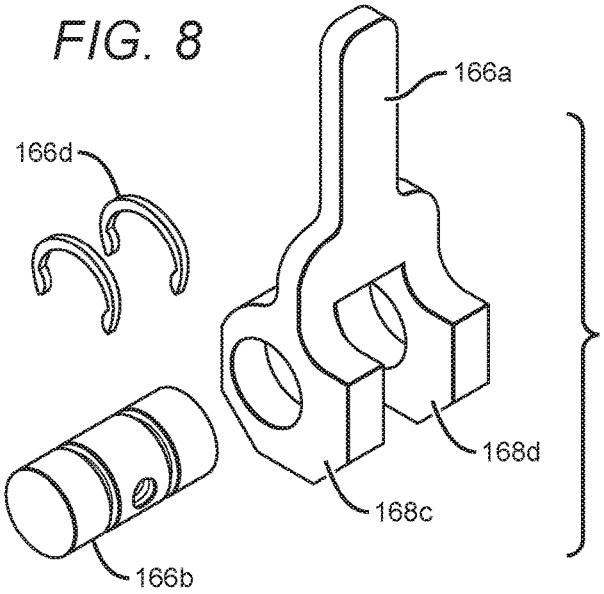
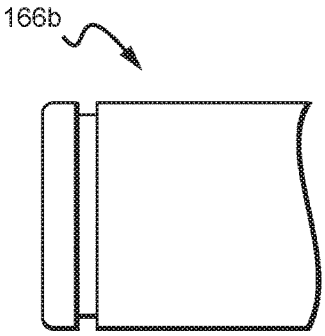
FIG. 9A
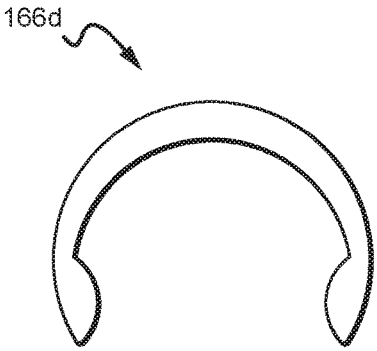
FIG. 9B
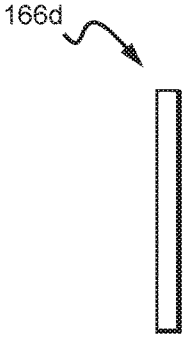
FIG. 9C
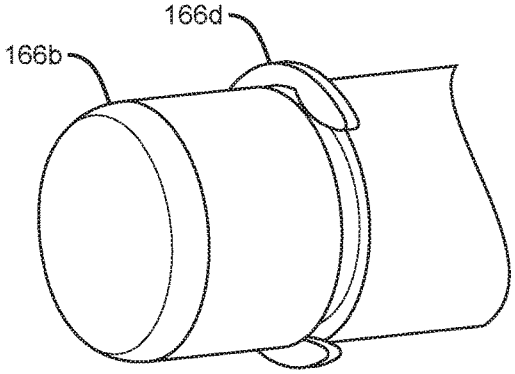
FIG. 9D

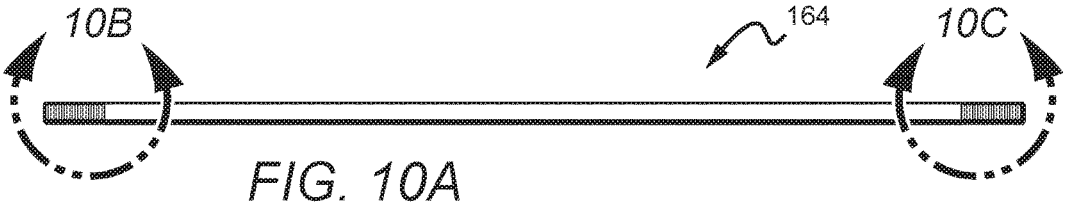
FIG. 10A
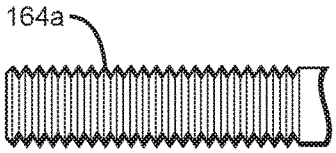
FIG. 10B
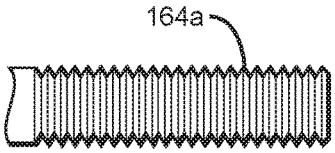
FIG. 10C
FIG. 11A
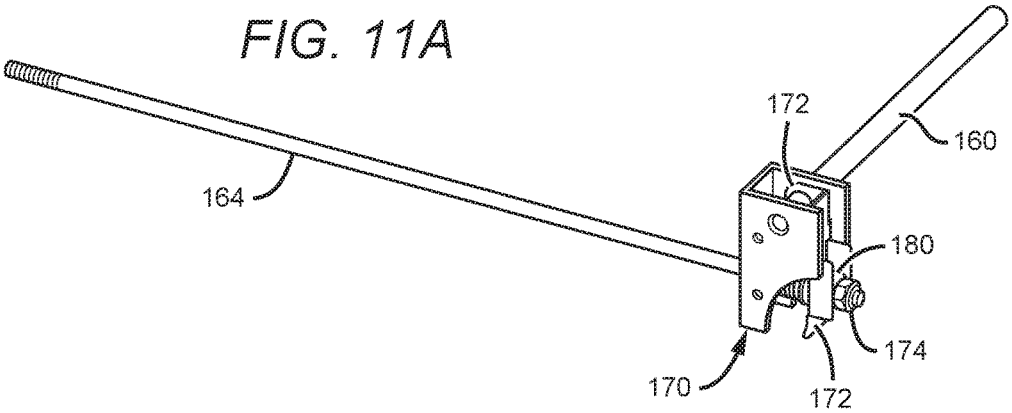
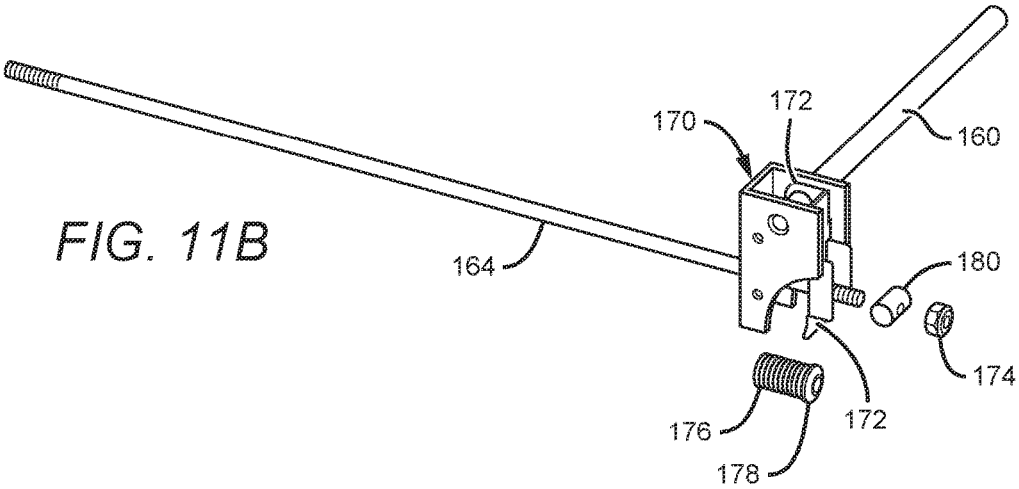
FIG. 11B

PERCUSSION INSTRUMENT WITH ADJUSTABLE AUXILIARY DEVICE

This application claims the priority of U.S. Provisional Pat. App. No. 62/447,399 to Sikra, entitled "Percussion Instrument with Multi-Position Lever" and filed on Jan. 17, 2017, which is fully incorporated by reference herein in its entirety.

BACKGROUND OF THE DISCLOSURE

Field of the Disclosure

This disclosure relates generally to percussion instruments, and more particularly to percussion instruments such as cajóns which can include a multi-position adjustment device, such as a lever device, holding one or more auxiliary devices such as one or more snares.

Description of the Related Art

A wide variety of percussion musical instruments have been developed and used in virtually every instrument-accompanied musical genre. One type of percussion instrument, the cajón, originated in Peru and first achieved widespread popularity in the 1850s. Today, the cajón, also known in some instances as a box drum, drum kit in a box, cajón box, or Cuban box drum, is an integral part of Peruvian, Cuban, and Latin music. Cajóns also often accompany acoustic guitars in modern, western contemporary music. The cajón is also becoming popular in styles such as blues, pop, rock, funk, fusion, and jazz.

Cajóns may be constructed in a variety of shapes sizes. Typically, a cajón comprises a wooden box upon which the musician sits. Five of the sides are constructed of wood that is, for example, half to three-quarter inch thick. A thinner sheet of wood (e.g., plywood) is fastened on as the sixth side and acts as the primary striking surface or head of the drum. This striking surface is often called the tapa. The side opposite the tapa may comprise one or more sound hole openings. Alternatively, the sound hole may be positioned on the side, bottom, or top of the cajón. Non-rectangular cajóns are also possible. For example, commonly owned U.S. Pat. No. 9,466,273 to Krol et al., which is fully incorporated by reference herein in its entirety, discloses an octagon-shaped cajón designed for playing in a user's lap or on a snare stand. Commonly owned U.S. Des. Pat. No. D786,337 to Chandontrikit discloses crescent-shaped cajóns. Many different shapes and styles are possible.

A cajón is played by tapping, slapping, or striking the tapa and/or other surfaces with the hands, feet and, in some cases, mallets and/or other handheld apparatus. The top and bottom edges of the tapa may be left unattached (or loosely connected) and may be slapped against the frame of the box. A cajón player typically sits astride the box and strikes the tapa located between their knees, and may also strike the side and/or rear surfaces of the cajón. The cajón produces markedly different sounds depending on the location the tapa or other surface is struck. This wide variety of sounds contributes to the cajón's popularity.

Cajóns may additionally comprise one or more auxiliary devices such as cords, guitar strings, rattles, or drum snares inside the cajón and pressed against the inner surface of the tapa or other cajón portion in order to alter the sound profile of the cajón. Examples of cajóns including auxiliary devices include commonly owned U.S. Pat. No. 9,087,497 to Krol et al., disclosing cajóns with adjustable guitar strings, and U.S. Pat. No. 9,466,273 to Krol et al., disclosing cajóns with snares abutting a top cajón surface, each of which is fully incorporated by reference herein in its entirety.

SUMMARY OF THE DISCLOSURE

One embodiment of a percussion instrument according to the present disclosure includes a tapa having a backside, and further includes a rear surface. An adjustment device is attached to the rear surface and an adjustment rod is operably linked to the adjustment device, with the adjustment rod between the rear surface and the tapa. An auxiliary bar runs approximately horizontally across the width of the backside of the tapa, and an auxiliary device such as a snare is attached to the auxiliary bar. Movement of the adjustment device from a first position to a second position causes translation movement of the adjustment rod, which in turn causes rotational movement of the auxiliary bar such that more or less of the auxiliary device is in contact with the tapa backside.

Another embodiment of a percussion instrument according to the present disclosure includes a body with a tapa and a body rear, the tapa having a backside. A lever device is attached to the body behind the body rear, and an auxiliary bar is included behind the tapa. One or more snares are attached to the auxiliary bar, each of the one or more snares including snare wires that are configured to be pressed against the tapa backside. An adjustment rod connects the lever device and the auxiliary bar. Rotation of the lever device in a first direction causes rearward movement of the adjustment rod and rotational movement of the auxiliary bar. Rotation of the lever device in a second direction causes forward movement of the adjustment rod and rotational movement of the auxiliary bar in a direction opposite the direction of the rotational movement of the auxiliary bar when the adjustment rod moves forward. Rotational movement of the auxiliary bar causes more or less of each of the snare wires to be pressed against the tapa backside.

One embodiment of a cajón according to the present disclosure includes a body having a tapa, the tapa having a backside. A lever device is attached to an outside of the body. The lever device includes a rotary portion and a lever portion attached to the rotary portion, as well as an axle through the rotary portion. The axle is in a non-centered position with respect to the rotary portion. An adjustment rod is operably linked to the axle. Rotation of the lever device in a first direction causes the axle to move closer to the body and the adjustment rod to move forward, whereas rotation of the lever device in the opposite direction causes the axle to move further from the body and the adjustment rod to move rearward.

This has outlined, rather broadly, the features and technical advantages of the present disclosure in order that the detailed description that follows may be better understood. Additional features and advantages of the disclosure will be described below. It should be appreciated by those skilled in the art that this disclosure may be readily utilized as a basis for modifying or designing other structures for carrying out the same purposes of the present disclosure. It should also be realized by those skilled in the art that such equivalent constructions do not depart from the teachings of the disclosure as set forth in the appended claims. The novel features, which are believed to be characteristic of the disclosure, both as to its organization and method of operation, together with further features and advantages, will be better understood from the following description when considered in connection with the accompanying figures. It is to be expressly understood, however, that each of the figures is provided for the purpose of illustration and description only and is not intended as a definition of the limits of the present disclosure.

BRIEF DESCRIPTION OF THE FIGURES

FIGS. 1A-1C are rear perspective, front perspective, and side views of a percussion instrument according to one embodiment of the present disclosure;

FIG. 2 is a magnified perspective view of a portion of the percussion instrument shown in FIGS. 1A-1C;

FIG. 8 is an exploded perspective view of parts of an auxiliary system according to one embodiment of the present disclosure;

FIG. 9A is a side view of a portion of a part of an auxiliary system according to one embodiment of the present disclosure; FIGS. 9B and 9C are front and side views of another part of an auxiliary system according to one embodiment of the present disclosure; and FIG. 9D is a perspective view of the parts shown in FIGS. 9A-9C;

FIG. 10A is a side view of an adjustment rod according to one embodiment of the present disclosure, and FIGS. 10B and 10C are magnified views of parts of the adjustment rod shown in FIG. 10A;

FIGS. 11A and 11B are perspective and exploded perspective views of auxiliary system componentry according to one embodiment of the present disclosure.

DETAILED DESCRIPTION

Percussion instruments such as cajóns including auxiliary devices such as snares are disclosed. The positioning of the auxiliary device or devices with respect to the main body of the percussion instrument can be adjustable so as to produce different sounds depending upon the auxiliary device position. In one embodiment, a lever device on the back of a cajón is used. The lever device is linked to one or more snares by an adjustment rod and/or an auxiliary bar. As the lever device is adjusted and/or rotated, the positioning of the one or more snares and the amount of the snare wires that is in contact with the back of the tapa is adjusted, resulting in different sounds when the cajón is played.

It is understood that when an element is referred to as being "on" another element, "attached to" another element, "connected to" another element, or similar, it can be directly on, attached to, or connected to the other element, or intervening elements may also be present. Furthermore, relative terms such as "inner", "outer", "upper", "top", "above", "lower", "bottom", "beneath", "below", and similar terms, may be used herein to describe a relationship of one element to another. Terms such as "higher", "lower", "wider", "narrower", and similar terms, may be used herein to describe angular and/or relative relationships. It is understood that these terms are intended to encompass different orientations of the elements or system in addition to the orientation depicted in the figures.

Although the terms first, second, etc., may be used herein to describe various elements, components, regions and/or sections, these elements, components, regions, and/or sections should not be limited by these terms. These terms are only used to distinguish one element, component, region, or section from another. Thus, unless expressly stated otherwise, a first element, component, region, or section discussed below could be termed a second element, component, region, or section without departing from the teachings of the present disclosure.

Embodiments of the disclosure are described herein with reference to view illustrations that are schematic illustrations. As such, the actual thickness of elements can be different, and variations from the shapes of the illustrations as a result, for example, of manufacturing techniques and/or tolerances are expected. Thus, the elements illustrated in the figures are schematic in nature and their shapes are not intended to illustrate the precise shape of a region and are not intended to limit the scope of the disclosure.

Figure 1B:
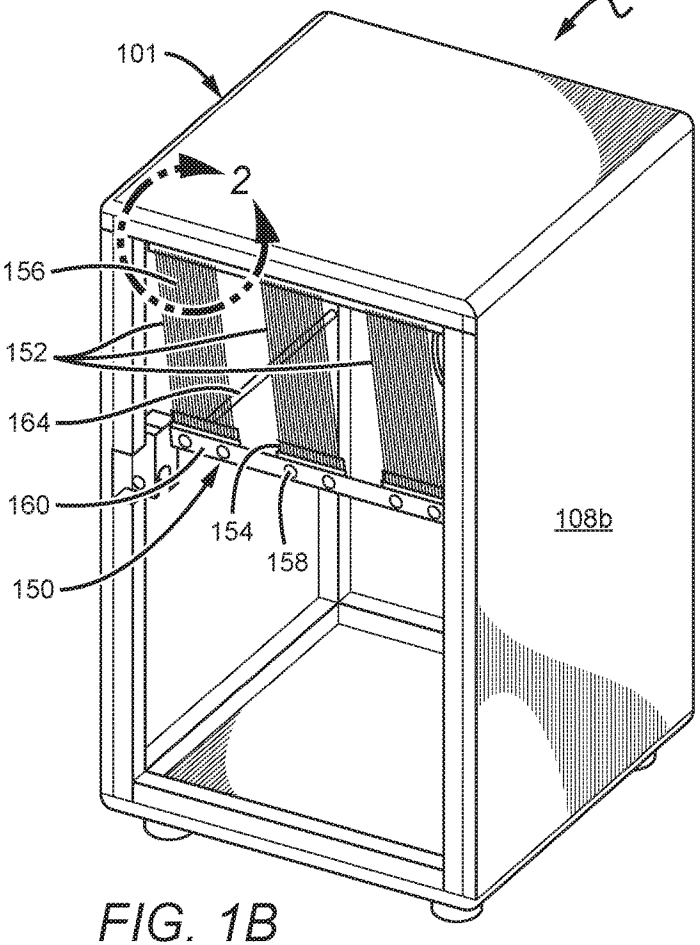
Figure 1A:
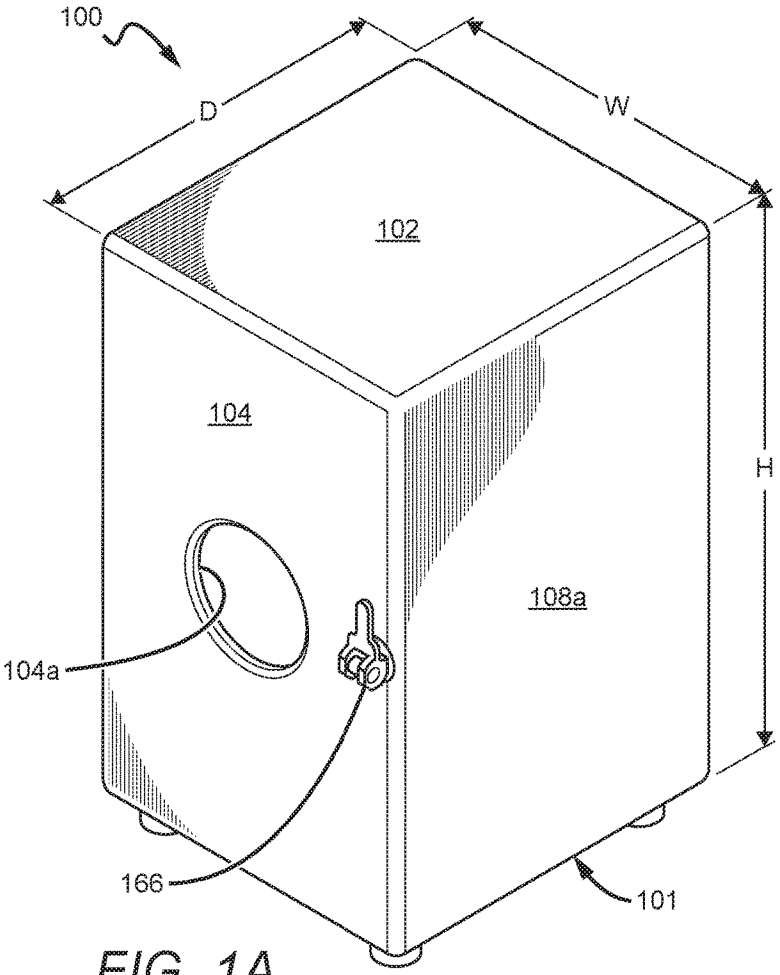

FIGS. 1A-1C show a percussion instrument 100 having a body 101 according to the present disclosure. The specific percussion instrument 100 is a cajón 100 and will be referred to as a cajón herein, although it is understood that the components, concepts, and methods described herein can be applied to other types of instruments and percussion instruments. Further, while the cajón 100 is rectangularly-shaped and box-shaped, it is understood that the components, concepts, and methods described herein can be applied to musical instruments such as cajóns having other shapes, such as cajóns having top cross-sections of regular and irregular polygons including five sides or more, such as six sides, eight sides, and ten sides, for example. Non-polygon shapes are also possible, such as circular or crescent-shaped cajóns, including but not limited to those described in U.S. Des. Pat. No. D786,337 to Chandontrikit, the entirety of which is fully incorporated by reference herein. Tapas and body rears and sides according to the present disclosure need not necessarily be flat or rectangular, but can also be curved and/or have non-rectangular shapes. Additionally, while the cajón 100 is shown as having a height larger than its width and depth, it is understood that embodiments having heights that are smaller than their widths and/or depths are possible. For example, the components, concepts, and methods described herein could be applied to cajóns that are relatively low-profile/short, and/or octagonal, such as those cajóns shown and described in commonly owned U.S. Pat. No. 9,466,273 to Krol et al., which is fully incorporated by reference herein in its entirety.

The cajón 100 is rectangularly-shaped and includes a top surface 102, rear surface and/or body rear 104, front surface or tapa (not shown in FIG. 1B so as to show the inside componentry of the cajón 100), and side surfaces and/or body sides 108 (specifically the side surface/body side 108*a* and the side surface/body side 108*b*). The rear surface/body rear 104 can be shaped to define one or more sound holes 104*a*. One or more other surfaces or body portions may also be shaped to define one or more sound holes, whether the rear surface includes a sound hole or not; many different embodiments and combinations are possible.

As can be seen best in FIG. 1B, the cajón 100 can include an auxiliary system 150. In this embodiment, the auxiliary system 150 is a snare system 150, although embodiments including components in place of or in addition to snares are possible, such as embodiments including guitar wires. The snare system 150 can include one or more snares 152 (in this embodiment, three snares 152). Part of one of the snares 152 is shown in the magnified perspective view of FIG. 2. The snares 152 can include one or more fittings 154 and snare wires 156. In this embodiment one fitting 154 is included in each snare 152, on one end of the snare wires 156, although a second fitting can be included on the other end of the snares wires 156 in one or more of the snares 152. The snares 152, such as the snare fittings 154, can be attached via fasteners 158 to an auxiliary bar 160 (in this case, a snare bar). Many different types of fasteners are possible, including but not limited to screws, nails, staples, adhesives, glue, etc., as well as combinations thereof. The term "bar" as used with regard to the auxiliary bar 166 does not necessarily imply any cross-sectional shape of element 166; the auxiliary bar 166 can have, for example, a circular, noncircular, or polygon cross-section, to name a few, and any shape of cross-section is possible.

The snare wires 156 can be angled such that an end portion 156*a* of the snares wires 156 can be held against a backside or back surface of the tapa. These end portions 156*a* can be held against the back surface of the tapa by a snare wire catch 162, best shown in FIG. 2, which can be a simple board, rod, bar, or similar device. In other embodiments portions of the snares wires 156 other than the end portions 156*a* can be held against the back surface of the tapa, whether or not the end portions 156*a* are also held against this back surface.

The cajón 100 can include an adjustment rod 164 which can be operably linked to an adjustment device 166, which in this specific embodiment is a lever device. This lever device can be similar to snare drum throw-off devices, such as those throw-off devices shown and described in commonly owned U.S. Pat. No. 7,902,444 to Good et al., and/or can be similar to snare drum tension adjustment devices such as those described in commonly owned U.S. Pat. No. 8,143,507 to Good et al., each of which is fully incorporated by reference herein in its entirety. The term "rod" as used with regard to the adjustment rod 164 does not necessarily imply any cross-sectional shape of element 164; the adjustment rod 164 can have, for example, a circular, noncircular, or polygon cross-section, to name a few, and any shape of cross-section is possible.

Figure 3A:
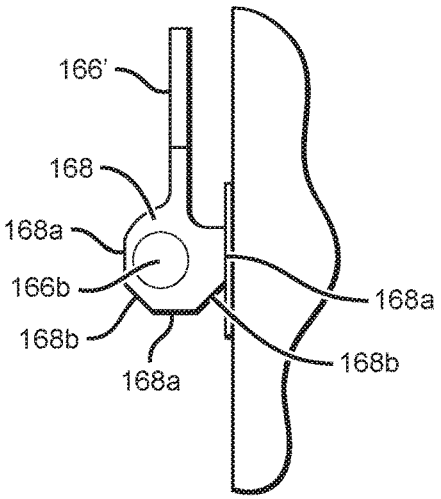
FIGS. 3A-3C are magnified side elevation views of a portion of the percussion instrument shown in FIGS. 1A-1C.
Figure 3C:
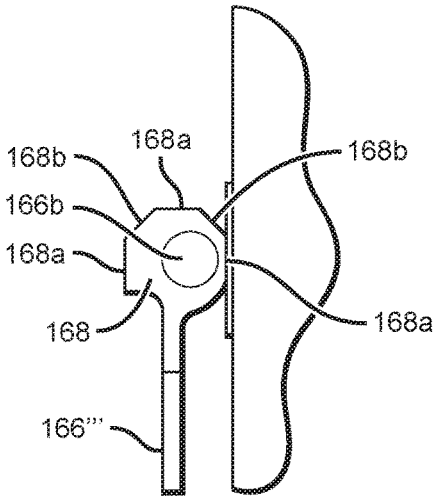
Figure 3B:
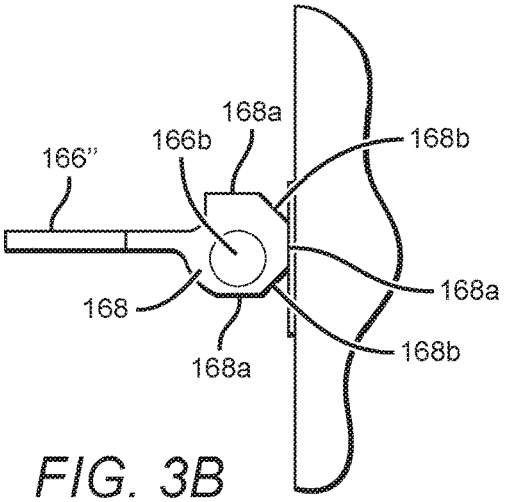

The adjustment device 166 can be adjusted and/or rotated to a number of different positions such as the exemplary positions 166', 166", 166'" as shown in FIGS. 1A/3A, FIG. 3B, and FIG. 3C, respectively. While in this specific embodiment the adjustment device 166 is shown in three discrete positions, it may have two discrete positions, three discrete positions four discrete positions, five discrete positions, six or more discrete positions, or a continuous range of positions such as a continuous range of positions between and including positions 166',166'". Combinations of discrete positions and continuous range(s) of positions are also possible. The position 166' will be referred to herein as the "maximum position" and the position 166'" will be referred to herein as the "minimum position," although it is understood that these can be interchanged. The shape of the portion of the lever that abuts the cajón body 101 and/or an intervening element may help to determine the number and/or other attributes of the positions. For instance, as shown in FIGS. 3A-3C, in each of the three positions a flat side 168*a* of a rotary portion 168 abuts the cajón, making each position a natural stopping point. The rotary portion 168 can include additional flat sides 168*b* which can also act as natural stopping points. The rotary portion 168 can be configured to rotate, such as about an axle or barrel 166*b*. In another embodiment the rotary portion 168 (or a portion thereof) may be curved, circular, or include a circle segment portion, which can be particularly adapted to a continuous range of positions. In other embodiments more flat sides can be included, which can be particularly adapted to more discrete positions. Many different embodiments are possible.

When the adjustment device 166 is in the maximum position, the adjustment rod 164, which is operably linked to the adjustment device 166, can be pushed to a forwardmost position (in FIG. 1B, coming out of the page along the length of the adjustment rod 164), or can be pulled to a rearwardmost position (in FIG. 1B, going into the page along the length of the adjustment rod 164); and when the adjustment device 166 is in the minimum position, the adjustment rod 164 can be in the other of the forwardmost and rearwardmost positions. In addition to being operably linked to the adjustment device 166, the adjustment rod 164 can be operably linked to the auxiliary bar 160. When the adjustment rod 164 is in the forwardmost position, the auxiliary bar 160 can be at a maximum forward angle such that the snare wires are angled the most forward (and out of the page) as possible, or a minimum forward angle such that the snare wires are angled the most rearward (and into the page) as possible; and when the adjustment rod 164 is in the rearwardmost position, the auxiliary bar 160 can be angled the other. When the adjustment device 166 is in a position between minimum and maximum (such as the position 166"), the adjustment rod 164 and the auxiliary bar 160 can also be in a position between minimum and maximum.

In the specific embodiment shown, the axle or barrel 166*b* is in a non-centered location of the rotary portion 168. The axle or barrel 166*b* is also operably linked to the adjustment rod 164, and in some embodiments the axle 166*b* and adjustment rod 164 are directly connected to one another. As shown in FIGS. 3A-3C, in the maximum position 166' the axle or barrel 166*b* is further away from the tapa body 101, meaning that the adjustment rod 164 has been pulled further out. The non-centered location of the axle or barrel 166*b* means that as it is rotated to the intermediary position 166" and then the minimum position 166'", the axle or barrel 166*b* moves closer to the body 101, and thus the adjustment rod 164 is pushed forward. As will be discussed below with regard to FIGS. 11A and 11B, this can cause the position of auxiliary devices such as the snares 152 to be adjusted.

The snare wires 156 can be flexible. In the rearwardmost position of the auxiliary bar 160, only a relatively small portion of the snare wires 156, such as only the ends 156*a*, may be in contact with the back surface of the tapa; or, no portion of the snare wires 156 may be in contact with the back surface of the tapa. In the forwardmost position of the auxiliary bar 160, a much larger portion of the snare wires 156 may be pressed against the back surface of the tapa, such that in one embodiment one quarter or more of the length of the snare wires 156 is against the back surface of the tapa, and in another embodiment one half or more of the length of the snare wires 156 is against the back surface of the tapa, and in another embodiment three quarters or more of the length of the snare wires 156 is against the back surface of the tapa, and in another embodiment one inch or more of the length of the snares wires 156 is against the back surface, and in another embodiment two inches or more of the snare wires 156 is against the back surface, and in another embodiment three or more of the length of the snares wires 156 is against the back surface, and in another embodiment six inches or more of the length of the snares wires 156 is against the back surface. Embodiments outside these ranges are also possible. In positions between the rearwardmost and forwardmost positions, a portion of the snare wires 156 between the portions of the rearwardmost and forwardmost positions may be in touch with the back surface of the tapa. Additionally, while FIG. 1B shows the snare wires 152 as extending upward from the adjustment rod 164, it is understood that they could extend downward, both upward and downward, or be positioned in other orientations and with other orientations of the adjustment rod 164, as would be understood by one of skill in the art.

Figure 4:
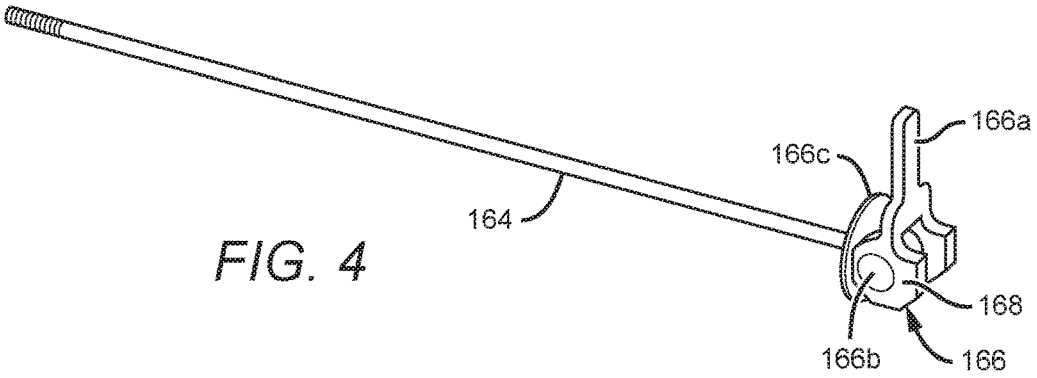
FIG. 4 is a perspective view of a part of an auxiliary system according to one embodiment of the present disclosure.
Figure 5A:
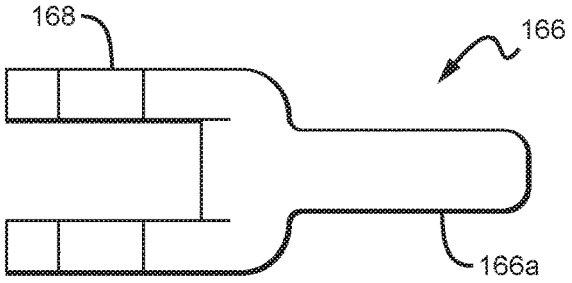
FIGS. 5A and 5B are top and side views of a part of an auxiliary system according to one embodiment of the present disclosure.
Figure 5B:
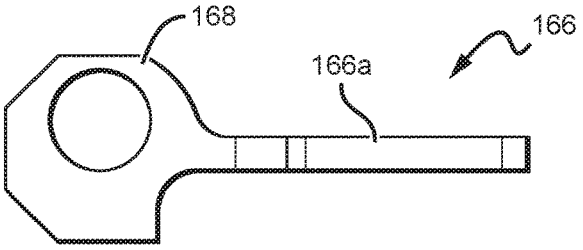
Figure 6A:
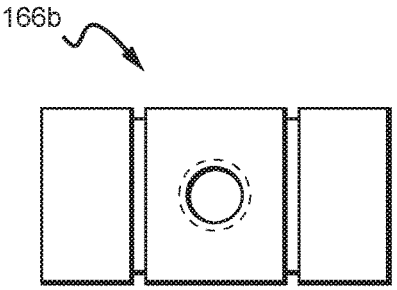
FIGS. 6A and 6B are front and side views of a part of an auxiliary system according to one embodiment of the present disclosure.
Figure 6B:
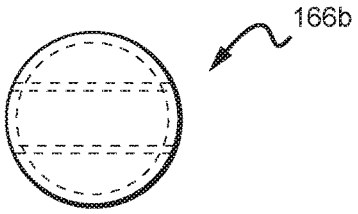
Figure 7A:
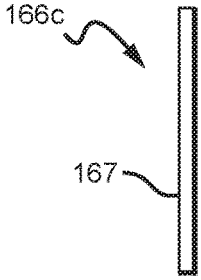
FIGS. 7A and 7B are side and front views of a mount device according to one embodiment of the present disclosure.
Figure 7B:
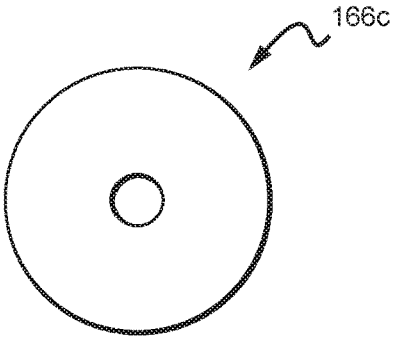

FIG. 4 shows one embodiment of the adjustment rod 164 and adjustment device 166. The adjustment device 166 can include an adjustment portion such as a lever portion 166*a*, the axle or barrel portion 166*b*, the rotary portion 168, and a mount portion or device such as a mount disk 166*c* (also shown in FIGS. 7A and 7B), which can be mounted on the rear surface 104 of the cajón 100 or another surface of the cajón 100. In the embodiment shown the lever portion 166*a* and rotary portion 168 are integral and a unitary piece, though other embodiments are possible. FIGS. 5A and 5B show top and side views of the adjustment device 166, FIGS. 6A and 6B show front and side views of the axle portion 166*b*, and FIGS. 7A and 7B show side and front views of the mount disk 166*c*. The flat sides 168*a*,168*b* of the rotary portion 168 can have lengths of, for example, 1/16" to 2", 1/8" to 1", 1/4" to 1/2", less than 1/16", less than 1/8", less than 1/4", less than 1/2", less than 1", less than 2", more than 1/16", more than 1/8", more than 1/4", more than 1/2", more than 1", more than 2", or other dimensions, as would be understood by those of skill in the art. Different sides of the rotary portion 168 can have different lengths. For instance, alternating sides 168*a*,168*b* can have alternating lengths. The mount disk 166*c* can include an adhesive such as adhesive backing 167 for mounting to the body 101 of the cajón 100 or to another device.

FIG. 8 shows the lever portion 166*a*, rotary portion 168, and axle portion or barrel 166*b*, with FIGS. 9A-9D showing additional views of the axle portion or barrel 166*b* and retaining rings 166*d*. The axle 166*b* can fit within an aperture of the rotary portion 168 (such as the rotary parts 168*c*,168*d*) as shown. Additionally, one or more retaining rings 166*d* can be placed on or over the axle portion 166*b*, such as in the grooves shown on the axle portion, once the axle portion 166*b* is within the rotary portion 168. The retaining rings 166*d* can then prevent the axle portion 166*b* from sliding out of the rotary portion 168. As shown in this specific embodiment, the rotary portion 168 can include two parts 168*c*, 168*d*. In other embodiments, the rotary portion 168 may include only a single part, or may include more than two parts.

FIG. 10A shows an adjustment rod 164 according to one embodiment of the present disclosure, with FIGS. 10B and 10C showing magnified views of portions of the adjustment rod 164. The adjustment rod 164 can include two threaded portions/ends, such as one for connection to an adjustment device such as the adjustment device 166, and one for connection to an auxiliary bar such as the auxiliary bar 160 or to an element intervening between the adjustment rod 164 and auxiliary bar 160, as described below with regard to FIGS. 11A and 11B.

FIGS. 11A and 11B show internal componentry which can be used to operably connect the adjustment rod 164 to the auxiliary bar 160. An auxiliary adjustment component 170 can be used for this purpose. The auxiliary adjustment component 170 can include a housing through which the adjustment rod 164 and auxiliary bar 160 can pass, as shown, though in other embodiments the adjustment rod 164 may not pass through such a housing. The auxiliary adjustment component 170 can include an axle or barrel 180, locking nut 174, spring 176, and/or metal button retainer 178 on the spring 176, and/or equivalent devices. The spring, barrel, and locking nut (or equivalent devices) can be arranged as shown in FIG. 11A so as to secure the connection between the adjustment rod 164 and the auxiliary adjustment component 170. The auxiliary adjustment component 170 can also include a bracket 172 which is connected to both the auxiliary bar 160 and the adjustment rod 164. Movement of the adjustment rod 164 can cause movement of the bracket 172, which can in turn cause movement (such as rotation) of the auxiliary bar 160 (and thus any auxiliary device attached thereto). In the specific embodiment shown the adjustment rod 164 is attached to a lower portion of the bracket 172 below where the auxiliary bar 160 is attached to the bracket 172 such that pushing the adjustment rod 164 forward causes backward rotation of the auxiliary bar 160, which can cause less of the auxiliary device(s) (e.g., snare(s)) to be pressed against the tapa backside. In the specific embodiment shown pulling the adjustment rod 164 back causes forward rotation of the auxiliary bar 160, which can cause more of the auxiliary device(s) (e.g., snare(s)) to be pressed against the tapa backside. It is understood that the placements can be altered so that forward motion of the adjustment rod causes forward rotation of the auxiliary bar (e.g., if the adjustment rod 164 were connected to an upper portion of the bracket 172 above the auxiliary bar 160), etc., as would be understood by one of skill in the art given the foregoing description and appended drawings. The spring can serve to bias the adjustment rod 164 forward or rearward as desired.

It is understood that all dimensions described above and/or in the attached figures are only exemplary in nature. Other dimensions are possible, including but not limited to the exemplary dimension plus or minus 10%, plus or minus 25%, plus or minus 50%, plus 100%, and many other dimensions. These dimensions should not be considered to be limiting.

It is understood that embodiments presented herein are meant to be exemplary. Embodiments of the present disclosure can comprise any combination of compatible features shown in the various figures, and these embodiments should not be limited to those expressly illustrated and discussed.

Although the present disclosure has been described in detail with reference to certain preferred configurations thereof, other versions are possible. Therefore, the spirit and scope of the disclosure should not be limited to the versions described above.

The foregoing is intended to cover all modifications and alternative constructions falling within the spirit and scope of the disclosure as expressed in the appended claims, wherein no portion of the disclosure is intended, expressly or implicitly, to be dedicated to the public domain if not set forth in the claims.

I claim:

1. A percussion instrument comprising:

a tapa having a backside;

a rear surface;

an adjustment device attached to said rear surface;

an adjustment rod operably linked to said adjustment device, said adjustment rod between said rear surface and said tapa;

an auxiliary bar running approximately horizontally across the width of said backside of said tapa; and an auxiliary device attached to said auxiliary bar;

wherein movement of said adjustment device from a first position to a second position causes translational movement of said adjustment rod, the translational movement of said adjustment rod causing rotational movement of said auxiliary bar such that said more or less of said auxiliary device is in contact with said tapa backside.

2. The percussion instrument of claim 1, wherein said auxiliary device is a snare.

3. The percussion instrument of claim 1, wherein said adjustment device comprises a lever.

4. The percussion instrument of claim 3, wherein said adjustment device further comprises a rotary portion attached to said lever, said rotary portion comprising three or more flat sides, each of said flat sides associated with a discrete position of said auxiliary device.

5. The percussion instrument of claim 1, wherein said adjustment device comprises a rotary portion, said rotary portion comprising three or more flat sides, each of said flat sides associated with a discrete position of said auxiliary device.

6. The percussion instrument of claim 1, further comprising a bracket operably linking said adjustment rod to said auxiliary bar.

7. The percussion instrument of claim 1, further comprising a spring operably linked to said adjustment rod and biasing said adjustment rod forward or backward.

8. A percussion instrument, comprising:

a body comprising a tapa and a body rear, said tapa comprising a tapa backside;

a lever device on said body and behind said body rear;

an auxiliary bar in said body and behind said tapa;

one or more snares attached to said auxiliary bar, each of said one or more snares comprising snare wires that are configured to be pressed against said tapa backside; and an adjustment rod connecting said lever device and said auxiliary bar;

wherein rotation of said lever device in a first direction causes rearward movement of said adjustment rod and rotational movement of said auxiliary bar;

wherein rotation of said lever device in a second direction opposite said first direction causes forward movement of said adjustment rod and rotational movement of said auxiliary bar in a direction opposite the direction of the rotational movement of said auxiliary bar when said adjustment rod moves rearward; and wherein rotational movement of said auxiliary bar causes more or less of each of said snare wires to be pressed against said tapa backside.

9. The percussion instrument of claim 8, wherein said lever device comprises a rotary portion and an axle, said axle placed in a non-centered position with respect to said rotary portion.

10. The percussion instrument of claim 9, wherein said rotary portion comprises a plurality of flat sides, each of said flat sides associated with a discrete position of said adjustment rod.

11. The percussion instrument of claim 9, wherein said rotary portion comprises at least one curved surface so as to enable a continuous range of positions of said adjustment rod.

12. The percussion instrument of claim 8, further comprising a bracket between said adjustment rod and said auxiliary bar.

13. The percussion instrument of claim 12, wherein said adjustment rod is attached to said bracket below where said auxiliary bar is attached to said bracket such that forward movement of said adjustment rod causes rearward rotation of said auxiliary bar and such that rearward movement of said adjustment rod causes forward rotation of said auxiliary bar.

14. The percussion instrument of claim 13, wherein rearward rotation of said auxiliary bar causes a smaller portion of said snare wires to be pressed against said tapa backside, and forward rotation of said auxiliary bar causes a larger portion of said snare wires to be pressed against said tapa backside.

15. The percussion instrument of claim 12, wherein said adjustment rod is attached to said bracket above where said auxiliary bar is attached to said bracket such that forward movement of said adjustment rod causes forward rotation of said auxiliary bar and such that rearward movement of said adjustment rod causes rearward rotation of said auxiliary bar.

16. The percussion instrument of claim 8, wherein said percussion instrument is a cajón.

17. A cajón, comprising:

a body comprising a tapa, said tapa comprising a tapa backside;

a lever device on an outside of said body, said lever device comprising:

a rotary portion;

a lever portion attached to said rotary portion; and an axle through said rotary portion, said axle in a non-centered position with respect to said rotary portion; and an adjustment rod operably linked to said axle;

wherein rotation of said lever device in a first direction causes said axle to move closer to said body and said adjustment rod to move forward, and rotation of said lever device in a second direction opposite said first direction causes said axle to move further from said body and said adjustment rod to move rearward.

18. The cajón of claim 17, wherein said rotary portion comprises a plurality of flat sides, each of said flat sides associated with a discrete position of said axle with respect to said body.

19. The cajón of claim 17, wherein said adjustment rod is between said axle and an auxiliary bar such that movement of said axle causes rotation of said auxiliary bar.

20. The cajón of claim 19, further comprising at least one snare attached to said auxiliary bar, and wherein rotation of said auxiliary bar causes more or less of said snare to be in contact with said tapa backside.

21. The cajón of claim 17, wherein said adjustment rod is directly connected to said axle.

22. The percussion instrument of claim 1, wherein said adjustment device comprises a curved surface such that a continuous range of adjustment positions is possible.

* * * * *